US007647860B2

(12) United States Patent
Cresswell et al.

(10) Patent No.: US 7,647,860 B2
(45) Date of Patent: Jan. 19, 2010

(54) DIAPHRAGM AND A DIAPHRAGM PUMP

(75) Inventors: David Cresswell, Killyleagh (GB); Richard Bovill, County Down (GB)

(73) Assignee: Munster Simms Engineering Limited, Bangor (GB)

( * ) Notice: Subject to any disclaimer, the term of this patent is extended or adjusted under 35 U.S.C. 154(b) by 335 days.

(21) Appl. No.: 11/661,081

(22) PCT Filed: Aug. 26, 2005

(86) PCT No.: PCT/GB2005/003351

§ 371 (c)(1),
(2), (4) Date: Aug. 8, 2007

(87) PCT Pub. No.: WO2006/021804

PCT Pub. Date: Mar. 2, 2006

(65) Prior Publication Data

US 2008/0110336 A1 May 15, 2008

(30) Foreign Application Priority Data

Aug. 26, 2004 (GB) ..... 0419050.0

(51) Int. Cl.
*F04B 43/02* (2006.01)
*F16J 3/00* (2006.01)

(52) U.S. Cl. ..... 92/98 D; 92/98 R

(58) Field of Classification Search ..... 92/98 D, 92/98 R, 96, 104
See application file for complete search history.

(56) References Cited

U.S. PATENT DOCUMENTS

| | | | | |
|---|---|---|---|---|
| 3,644,062 | A | 2/1972 | Cozic | |
| 4,781,362 | A | 11/1988 | Reuter et al. | |
| 5,950,523 | A * | 9/1999 | Reynolds | 92/98 R |
| 6,227,824 | B1 | 5/2001 | Stehr | |
| 6,447,261 | B1 | 9/2002 | McCook | |
| 2004/0018094 | A1 | 1/2004 | Rossman | |

FOREIGN PATENT DOCUMENTS

| | | |
|---|---|---|
| GB | 1 347 844 | 2/1974 |
| WO | WO 2004/007961 A1 | 1/2004 |

* cited by examiner

*Primary Examiner*—Thomas E Lazo
(74) *Attorney, Agent, or Firm*—Ronald E. Greigg

(57) ABSTRACT

A diaphragm for a diaphragm pump, which diaphragm is asymmetrical about its longitudinal axis wherein the diaphragm has a central portion and a surrounding annular convolute portion. The convolute portion has a minimum depth and a maximum depth at diametrically opposed positions of the annular convolute. The convolute depth gradually increases from the minimum depth to the maximum depth between the diametrically opposed positions along each opposing half-section of the annular convolute. The invention also provides a diaphragm pump with the asymmetrical diaphragm.

37 Claims, 5 Drawing Sheets

DIAPHRAGM AND A DIAPHRAGM PUMP

CROSS-REFERENCE TO RELATED APPLICATION

This application is a 35 USC 371 application of PCT/GB 2005/003351 filed on Aug. 26, 2005.

BACKGROUND OF THE INVENTION

1. Field of the Invention

This invention relates to a diaphragm and in particular to a diaphragm for use with pumps commonly used in marine products.

2. Description of the Prior Art

Diaphragm pumps are well known in the prior art comprising a flexible diaphragm in place of a piston. One type of pump which commonly uses a flexible diaphragm is a bilge pump and bilge pumps currently available use a symmetric diaphragm with a diaphragm support plate attached thereto. A pumping arm/handle is coupled to the diaphragm support plate by a hinge which allows the pivotal motion of the pumping arm/handle to be converted into substantially reciprocating motion of the diaphragm support plate.

SUMMARY OF THE INVENTION

It is an object of the present invention to remove the need for a hinge coupling between the diaphragm support plate and the pumping arm of the pump thereby reducing the number of moving parts in the pump in order to reduce manufacturing, assembly and maintenance costs.

Accordingly, the present invention provides a diaphragm which is asymmetrical about its longitudinal axis.

Preferably, the diaphragm has a central portion and a surrounding annular convolute portion, the convolute portion having a minimum depth and a maximum depth at diametrically opposed positions of the annular convolute, the convolute depth gradually increasing from the minimum depth to the maximum depth between the diametrically opposed positions along each opposing half-section of the annular convolute.

Ideally, the diaphragm has a flange disposed along the free edge of the convolute.

Preferably, the flange is an inverted L-shape in cross-section.

Ideally, a locating lug extends from the free end of inverted L-shaped flange at least one position of the circumference of the flange. Advantageously, the lug prevents the diaphragm from rotating relative to any body it is mounted on by engaging with an aperture formed in the body.

Ideally, the central portion is a plate.

Preferably, the plate is a flat disc.

Ideally, the plate has an ovoid shape.

Preferably, the convolute portion comprises one or more u-shaped annular convolutes.

Accordingly, the present invention also provides a diaphragm pump having a diaphragm which is asymmetrical about its longitudinal axis.

Preferably, the diaphragm has a central portion and a surrounding annular convolute portion having a minimum depth and a maximum depth at diametrically opposed positions around the annular convolute, the convolute depth gradually increasing from the minimum depth to the maximum depth between the diametrically opposed positions along each opposing half-section of the annular convolute.

It will of course be appreciated that the surrounding convolute need not be annular but could be triangular, rectangular, square or any geometric shape provided it has a maximum and a minimum depth at opposed sides of the shape to accommodate the arcuate motion of the pumping arm/lever.

Ideally, a flange is disposed along the free edge of the convolute portion.

Preferably, the flange is an inverted L-shape in cross-section.

Ideally, a locating lug extends from the free end of the inverted L-shaped flange at least one position of the circumference of the flange. Advantageously, the lug prevents the diaphragm from rotating relative to any body it is mounted on by engaging with an aperture formed in the body.

Ideally, the central portion is a plate.

Preferably, the plate is a flat disc.

Ideally, the plate has an ovoid shape.

Ideally, the central portion has a diaphragm support plate mounted thereon which is fixed to a pumping arm/handle of the diaphragm pump.

Preferably, the central portion has a peripheral upwardly and inwardly protruding lip defining a partially enclosed recess for securely retaining the diaphragm support plate.

Advantageously, the hinge which normally connects the pumping arm/handle to the symmetrical diaphragm of a standard bilge pump is no longer required as a result of the incorporation of the diaphragm asymmetrical about its longitudinal axis.

Ideally, the diametrical position at which the depth of the surrounding annular convolute is at a minimum is located proximal to the mounting point of the pumping arm/handle to a base of the diaphragm pump and the diametrically opposed maximum depth of the convolute is located distal to the mounting point of the pumping arm/handle to the base.

Preferably, a diameter extending between the minimum depth of the convolute and the maximum depth of the convolute is substantially aligned with the pumping plane of the pumping arm/handle.

Ideally, the diaphragm is manufactured from Santoprene™.

BRIEF DESCRIPTION OF THE DRAWINGS

The invention will now be described herein below with reference to the accompanying drawings, which show one embodiment of a diaphragm and diaphragm pump in accordance with the invention, and in which:

FIG. A is a plan view of a prior art diaphragm;

Figure 1:
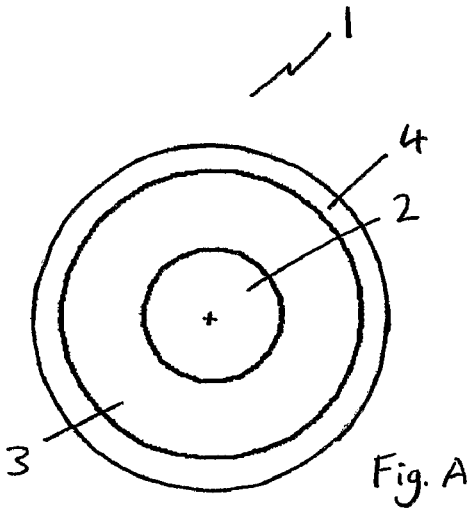
Figure 1:
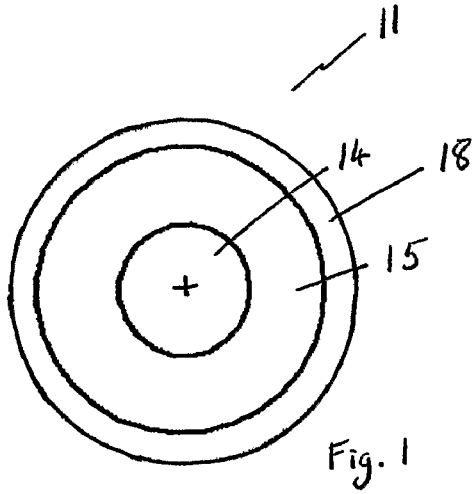
Figure 2:
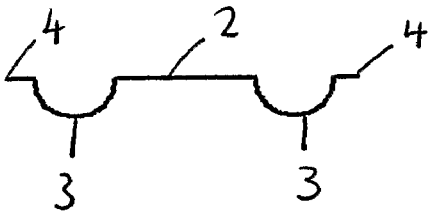
Figure 2:
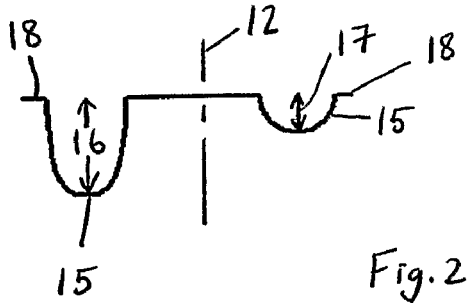
Figure 3:
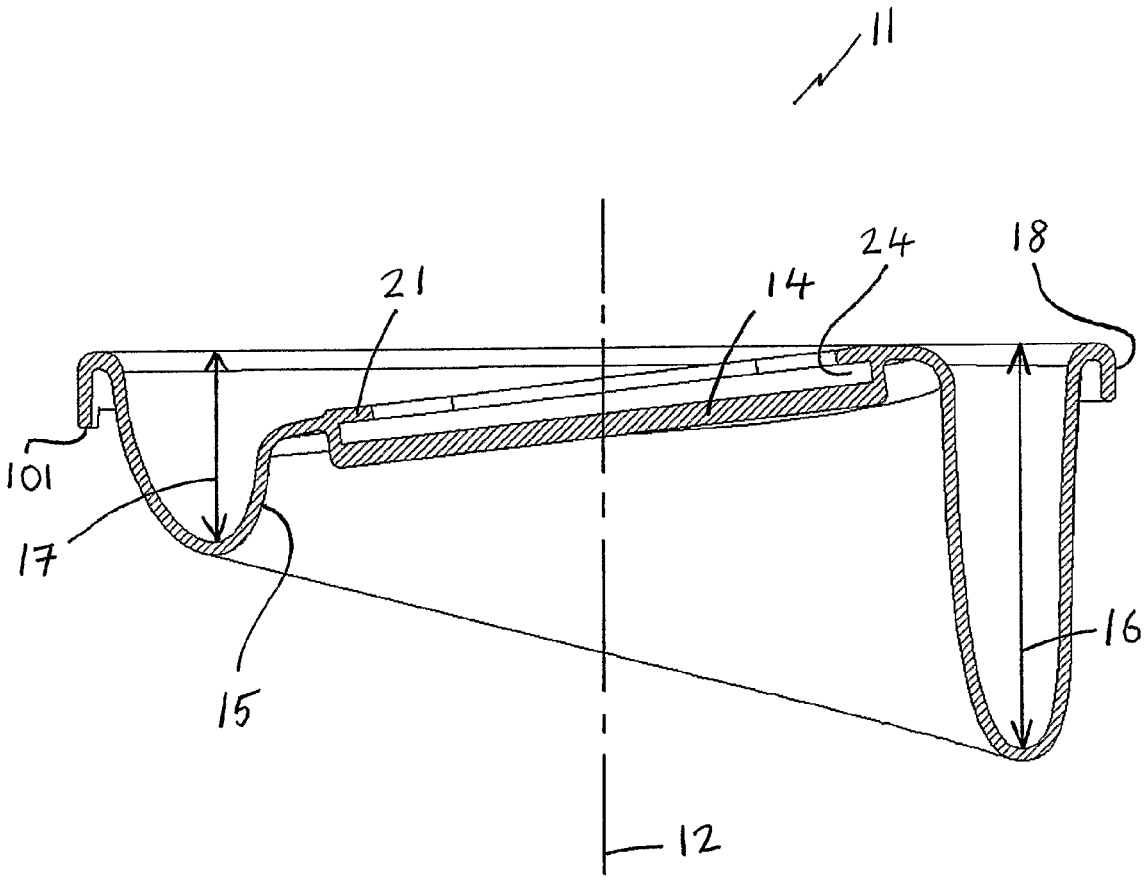

FIG. B is a cross-sectional view of the prior art diaphragm of FIG. A;

FIG. 1 is a plan view of a diaphragm of the invention;

FIG. 2 is a cross-sectional view of the diaphragm of FIG. 1;

FIG. 3 is a cross-sectional perspective view of the diaphragm of FIGS. 1 and 2.

Figure 4:
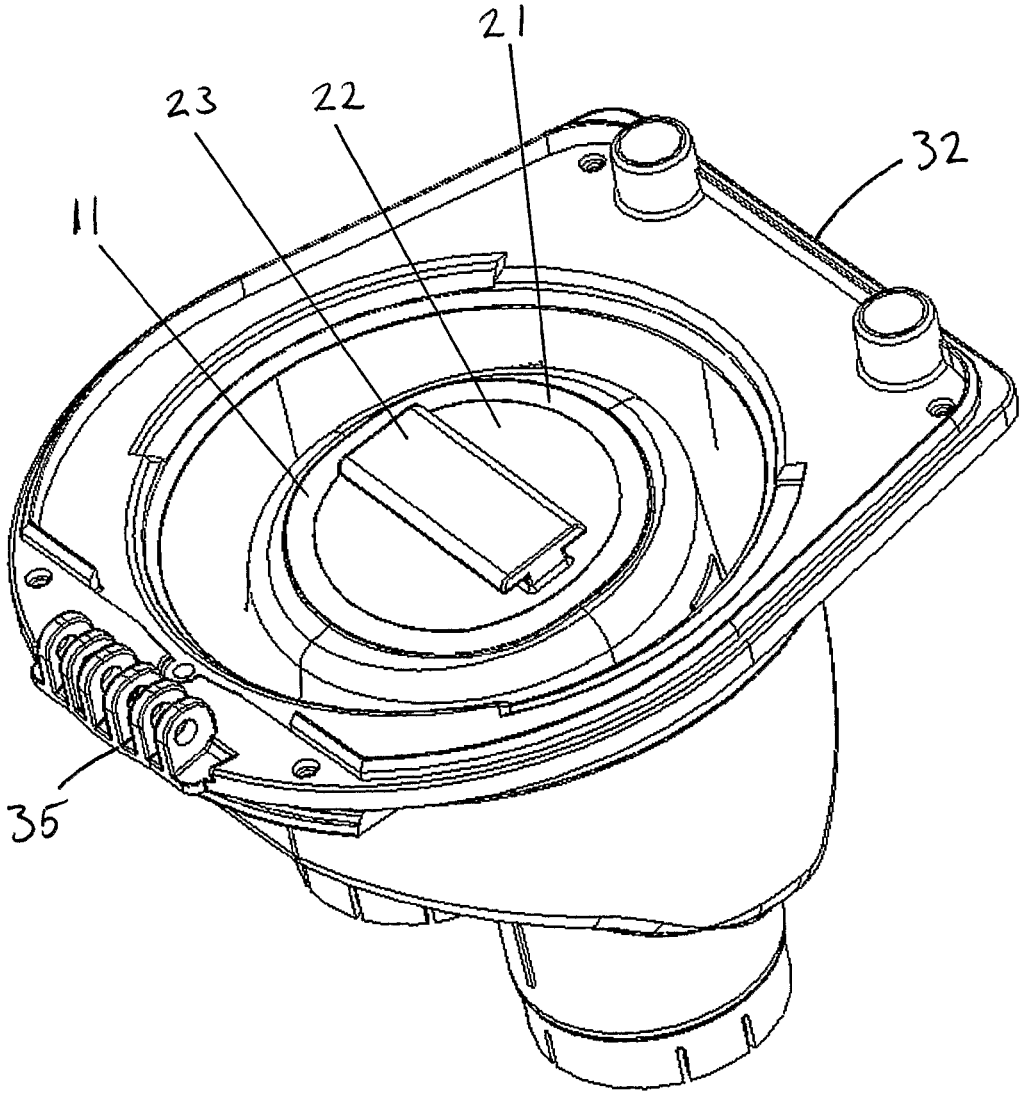
Figure 5:
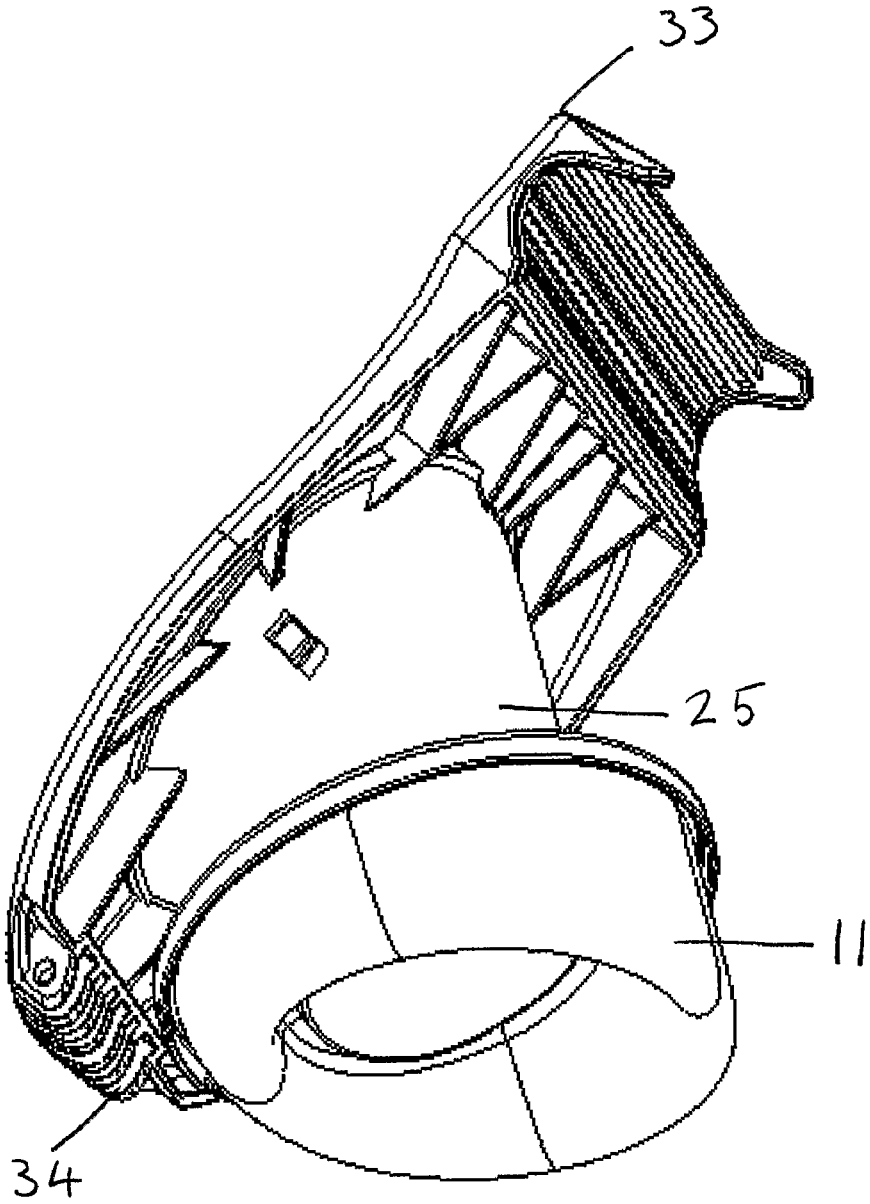
Figure 6:
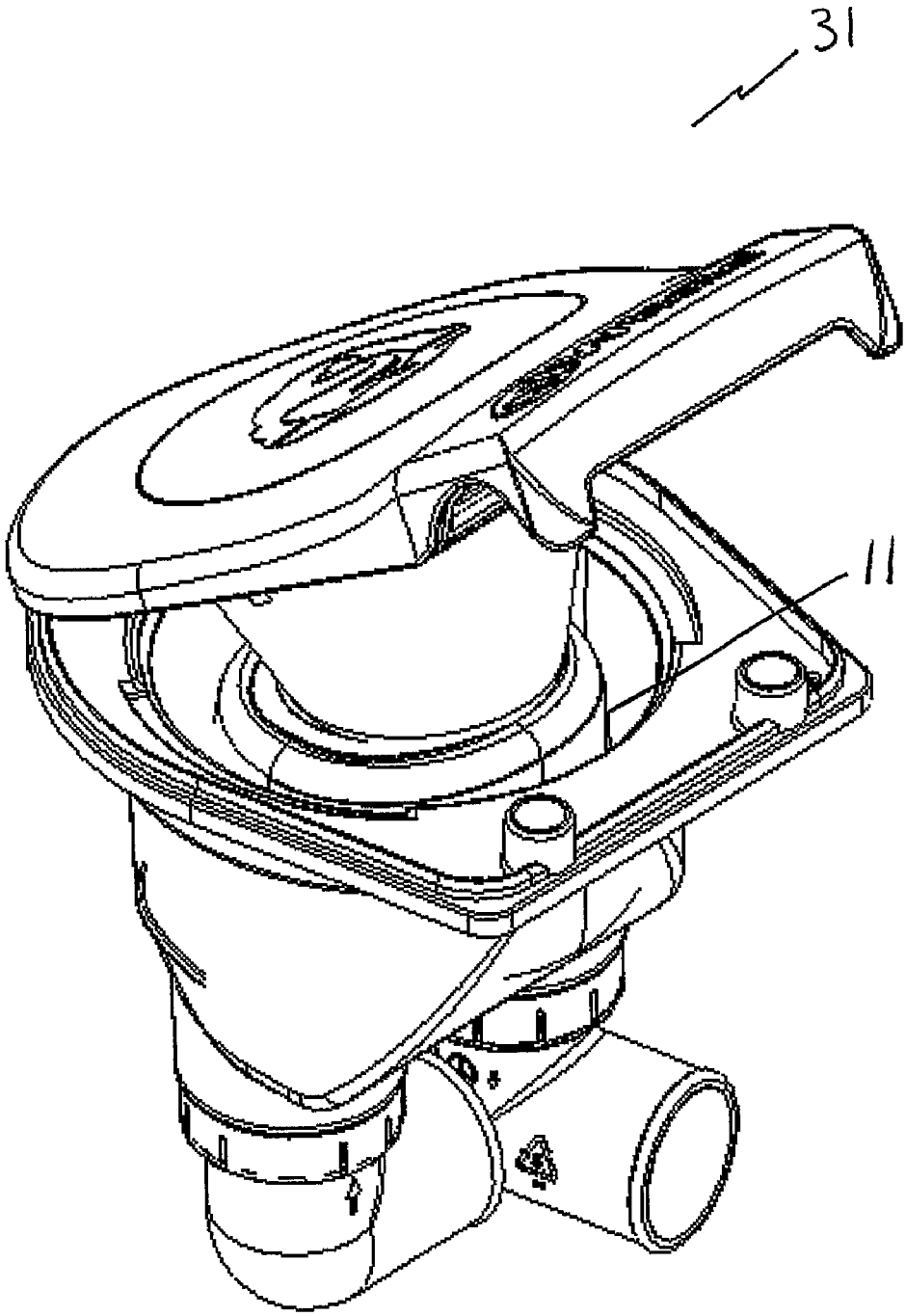

FIG. 4 is a perspective view of a base of a diaphragm pump embodying the invention;

FIG. 5 is a perspective view of a pumping arm/handle of a diaphragm pump embodying the invention; and FIG. 6 is a perspective view of an assembled diaphragm pump embodying the invention.

DESCRIPTION OF THE PREFERRED EMBODIMENT

Referring to the drawings and initially to FIGS. A and B, there is show a plan and cross-sectional view of a prior art diaphragm indicated generally by the reference numeral 1.

The diaphragm 1 has a plate 2 and a symmetrical annular convolute 3 surrounding the plate 2. The convolute 2 has a peripheral flange 4.

Referring now to FIGS. 1, 2 and 3, a plan view, a cross-sectional view and a perspective cross-sectional view respectively are shown of the diaphragm of the present invention, the diaphragm being indicated generally by the reference numeral 11. The diaphragm 11 is asymmetrical about its longitudinal axis 12. The diaphragm 11 has a central plate section 14 surrounded by an annular u-shaped convolute 15 having a maximum depth 16 and a minimum depth 17 at diametrically opposed points of the plate 14. The depth of the convolute 15 gradually increases from the minimum depth 17 to the maximum depth 16 between the diametrically opposed positions along both opposing half-sections of the annular convolute 15. The diaphragm 11 has a peripheral flange 18 extending from the free edge or end of the convolute 15 distal from the plate section 14. The flange 18 is an inverted L-shape in cross-section and a locating lug 101 extends from the free end of the inverted L-shaped flange 18 at one position of the circumference of the flange 18. Advantageously, the locating lug 101 prevents the diaphragm 11 from rotating relative to any body it is mounted on.

Referring now to FIGS. 4, 5,and 6, there is shown a diaphragm pump indicated generally in FIG. 6 by the reference numeral 31 and having a base 32 (FIG. 4) and a pumping arm/handle 33, (FIG. 5) pivotally mounted on the base 32 via pivotal mounting bracket 34, 35. The asymmetrical diaphragm 11 is mounted on the diaphragm pump 31 and the plate section 14 has a peripheral upwardly and radially inwardly protruding lip 21 (FIG. 3) defining a partially enclosed recess 24 for securely retaining a diaphragm support plate 22 (FIG. 4). The diaphragm support plate 22 has a connector 23 for engaging an undercut slot (not shown) formed in a connector 25 on the pumping arm/handle 33.

The diametrical position at which the depth of the surrounding annular u-shaped convolute 15 is at a minimum 17 is located proximal to the pivotal mounting bracket 34, 35 and the diametrically opposed maximum depth 16 of the convolute 15 is located distal from the mounting bracket 34, 35. The movement of the diaphragm 11 is arcuate and therefore less material and depth of convolute 15 is required on the inner radius of the arc. The diaphragm 11 is optionally manufactured from Santoprene™.

Variations and modifications can be made without departing from the scope of the invention and it is intended to include all embodiments which would be apparent to one skilled in the art and which come within the spirit and scope of the invention.

The invention claimed is:

1. A pump diaphragm which is asymmetrical about an axis substantially perpendicular to a main plane of the diaphragm, the diaphragm comprising a central portion and a surrounding convolute portion, the convolute portion having a minimum depth and a maximum depth at opposed positions of the convolute, the convolute depth gradually increasing from the minimum depth to the maximum depth between the opposed positions along each opposing half-section of the convolute.

2. A diaphragm according to claim 1, wherein the surrounding convolute portion is a surrounding annular convolute portion, the annular convolute portion having a minimum depth and a maximum depth at diametrically opposed positions of the annular convolute, the convolute depth gradually increasing from the minimum depth to the maximum depth between the diametrically opposed positions along each opposing half-section of the annular convolute.

3. A diaphragm according to claim 2, wherein the diaphragm further comprises a flange disposed along the free edge of the convolute.

4. A diaphragm according to claim 3, wherein the convolute portion comprises one or more u-shaped annular convolutes.

5. A diaphragm according to claim 2, wherein the central portion is a plate.

6. A diaphragm according to claim 5, wherein the plate is a flat disc.

7. A diaphragm according to claim 6, wherein the convolute portion comprises one or more u-shaped annular convolutes.

8. A diaphragm according to claim 5, wherein the convolute portion comprises one or more u-shaped annular convolutes.

9. A diaphragm according to claim 2, wherein the convolute portion comprises one or more u-shaped annular convolutes.

10. A diaphragm according to claim 1, wherein the diaphragm further comprises a flange disposed along the free edge of the convolute.

11. A diaphragm according to claim 10, wherein the central portion is a plate.

12. A diaphragm according to claim 11, wherein the plate is a flat disc.

13. A diaphragm according to claim 12, wherein the convolute portion comprises one or more u-shaped annular convolutes.

14. A diaphragm according to claim 11, wherein the convolute portion comprises one or more u-shaped annular convolutes.

15. A diaphragm according to claim 10, wherein the convolute portion comprises one or more u-shaped annular convolutes.

16. A diaphragm according to claim 1, wherein the central portion is a plate.

17. A diaphragm according to claim 16, wherein the plate is a flat disc.

18. A diaphragm according to claim 17, wherein the convolute portion comprises one or more u-shaped annular convolutes.

19. A diaphragm according to claim 16, wherein the convolute portion comprises one or more u-shaped annular convolutes.

20. A diaphragm according to claim 1, wherein the convolute portion comprises one or more u-shaped annular convolutes.

21. A diaphragm pump comprising a diaphragm which is asymmetrical about an axis substantially perpendicular to a main plane of the diaphragm, the diaphragm having a central portion and a surrounding convolute portion, the convolute portion having a minimum depth and a maximum depth at opposed positions of the convolute, the convolute depth gradually increasing from the minimum depth to the maximum depth between the opposed positions along each opposing half-section of the convolute.

22. A diaphragm pump according to claim 21, wherein the surrounding convolute portion is a surrounding annular convolute portion having a minimum depth and a maximum depth at diametrically opposed positions around the annular convolute portion, the convolute depth gradually increasing from the minimum depth to the maximum depth between the diametrically opposed positions along each opposing half-section of the annular convolute portion.

23. A diaphragm pump according to claim 22, further comprising a flange disposed along the free edge of the convolute portion.

24. A diaphragm pump according to claim 23, wherein the central portion comprises a peripheral upwardly and inwardly protruding lip defining a partially enclosed recess for securely retaining the diaphragm support plate.

25. A diaphragm pump according to claim 22, wherein the central portion comprises a diaphragm support plate mounted thereon, which support plate is fixed to a pumping handle of the diaphragm pump.

26. A diaphragm pump according to claim 25, wherein the central portion comprises a peripheral upwardly and inwardly protruding lip defining a partially enclosed recess for securely retaining the diaphragm support plate.

27. A diaphragm pump according to claim 22, wherein the central portion has a peripheral upwardly and inwardly protruding lip defining a partially enclosed recess for securely retaining the diaphragm support plate.

28. A diaphragm pump according to claim 21, further comprising a flange disposed along the free edge of the convolute portion.

29. A diaphragm pump according to claim 28, wherein the central portion comprises a diaphragm support plate mounted thereon, which support plate is fixed to a pumping handle of the diaphragm pump.

30. A diaphragm pump according to claim 29, wherein the central portion comprises a peripheral upwardly and inwardly protruding lip defining a partially enclosed recess for securely retaining the diaphragm support plate.

31. A diaphragm pump according to claim 28, wherein the central portion comprises a peripheral upwardly and inwardly protruding lip defining a partially enclosed recess for securely retaining the diaphragm support plate.

32. A diaphragm pump according to claim 21, wherein the central portion comprises a diaphragm support plate mounted thereon, which support plate is fixed to a pumping handle of the diaphragm pump.

33. A diaphragm pump according to claim 32, wherein the central portion comprises a peripheral upwardly and inwardly protruding lip defining a partially enclosed recess for securely retaining the diaphragm support plate.

34. A diaphragm pump according to claim 21, wherein the central portion comprises a peripheral upwardly and inwardly protruding lip defining a partially enclosed recess for securely retaining the diaphragm support plate.

35. A diaphragm pump according to claim 21, wherein the central portion is a plate.

36. A diaphragm pump according to claim 21, wherein the pump further comprises a base and a pumping handle pivotally mounted on the base, and wherein the position at which the depth of the surrounding convolute is at a minimum is located proximal to the mounting point of the pumping handle and the opposed maximum depth of the convolute is located distal to the mounting point of the pumping handle to the base.

37. A diaphragm pump according to claim 21, wherein the pump further comprises a base and a pumping handle pivotally mounted on the base, and wherein a diameter extending between the minimum depth of the convolute and the maximum depth of the convolute is substantially aligned with the pumping plane of the pumping handle.

* * * * *